United States Patent [19]

Teagno

[11] 4,053,197

[45] Oct. 11, 1977

[54] ELECTRICAL CONNECTOR

[75] Inventor: Vladimiro Teagno, Turin, Italy

[73] Assignee: AMP Incorporated, Harrisburg, Pa.

[21] Appl. No.: 709,980

[22] Filed: July 30, 1976

[30] Foreign Application Priority Data

Aug. 2, 1975 United Kingdom ..... 32385/75

[51] Int. Cl.[2] ..... H01R 11/20

[52] U.S. Cl. ..... 339/99 R

[58] Field of Search ..... 339/97 R, 97 C, 97 P, 339/98, 99 R

[56] References Cited

U.S. PATENT DOCUMENTS

| | | | |
|---|---|---|---|
| 3,191,281 | 6/1965 | Cobaugh | 339/97 R |
| 3,243,757 | 3/1966 | Cobaugh | 339/97 R |
| 3,434,093 | 3/1969 | Wedekind | 339/99 R |
| 3,768,067 | 10/1973 | Rault | 339/99 R |

*Primary Examiner*—Roy Lake
*Assistant Examiner*—Mark S. Bicks
*Attorney, Agent, or Firm*—Allan B. Osborne

[57] ABSTRACT

A connector comprising first and second insulating housings each having one or more terminal-receiving passageways, intermateable male and female terminals received in the or each passageway of respective housings, the or each female terminal comprising a web opposite edges of which are rolled over to define a pair of spring arms having free ends adjacent the web and the or each male terminal comprising a tab insertable longitudinally between the free ends of the arms and the or each web, the terminals and housings being provided with abutting surfaces enabling the terminals to be intermated by relative movement together of the housing to strip the insulation from an end of an insulated conductor located between the or each male and female terminal transversely of the web and to wedge the core longitudinally between the tab and the web to form an electrical connection, either the or each male or the or each female terminal having a contact portion accessible from the exterior of the housings when they have been moved together.

4 Claims, 4 Drawing Figures

FIG.1.
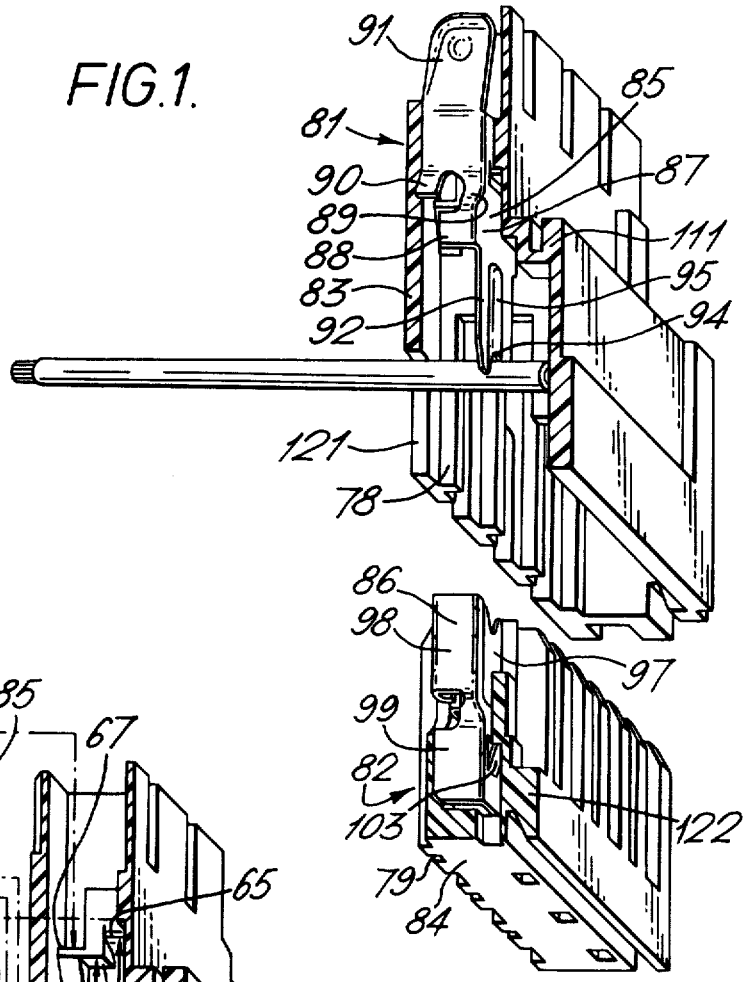
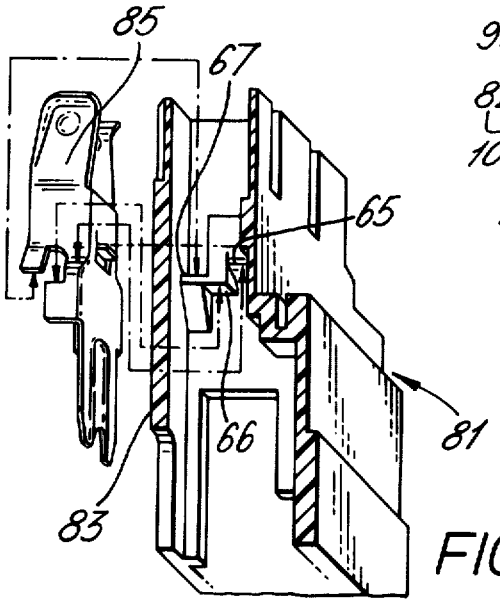
FIG.2.

FIG.3.
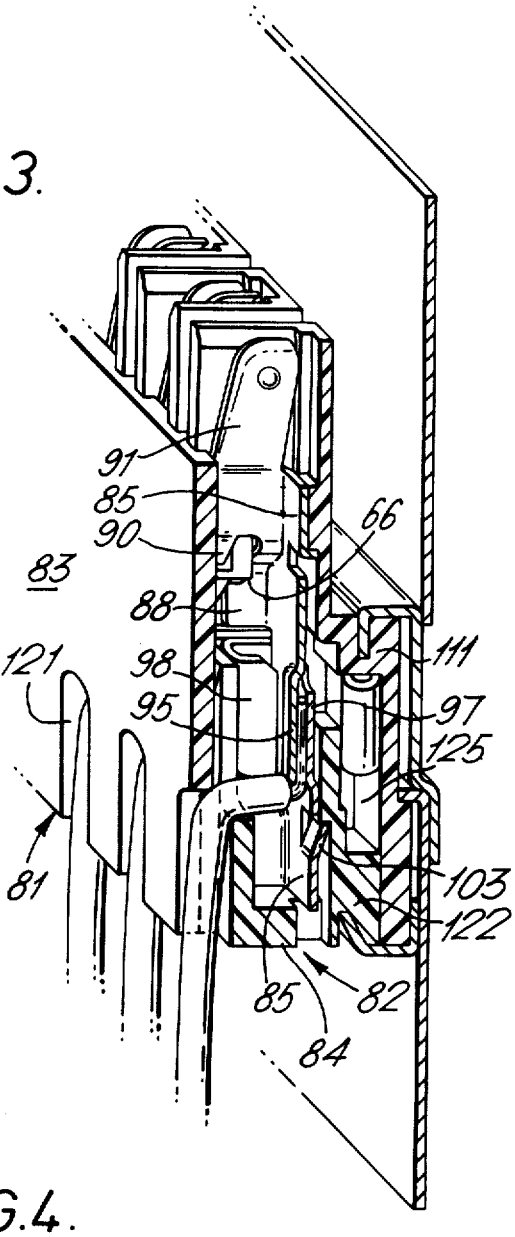
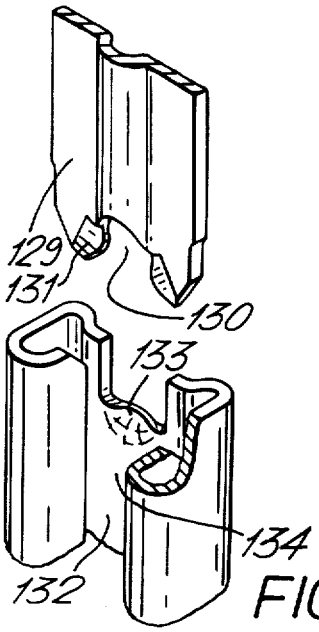
FIG.4.

ELECTRICAL CONNECTOR

The invention relates to connectors and particularly to connectors for mass terminating a series of stranded wires.

Such connectors are, for example, for use in harness assemblies comprising two connectors each having a row of terminals connected to respective ends of wires of a bundle of insulated wires which extend between the connectors.

According to one aspect of the invention a connector comprises first and second insulating housings each having one or more terminal-receiving passageway, intermateable male and female terminals received in the or each passageway of respective housings, the or each female terminal comprising a web, opposite edges of which are rolled over to define a pair of spring arms having free ends adjacent the web and the or each male terminal comprising a tab insertable longitudinally between the free ends of the arms and the or each web, the terminals and housings being provided with abutting surfaces enabling the terminals to be intermated by relative movement together of the housing to strip the insulation from an end of an insulated conductor located between the or each male and female terminal transversely of the web to form an electrical connection, either the or each male or the or each female terminal having a contact portion accessible from the exterior of the housings when they have been moved together.

An advantage of the invention is that a series of stranded wires of different sizes can be mass terminated in the connector.

A specific example of the invention will now be described with reference to the accompanying drawings in which:

FIG. 1 is a perspective view of the connector parts, partly in cross-section;

FIG. 2 is an exploded view of a tab connector and housing;

FIG. 3 is a perspective view partly in cross-section of the connector assembly; and, FIG. 4 is a perspective fragmentary view of a modified male and female terminal.

A connector assembly includes first and second connector parts 81, 82 each comprising insulating housings 83, 84 respectively, formed with aligned terminal-receiving passageways having male and female terminals 85, 86.

The male terminal is stamped and formed from a single piece of sheet metal stock and includes a body 87 formed at opposite ends with a tab-receiving portion and a wire-connecting portion, respectively. The body includes a central web opposite edges of which are bent up to define feet 88 on one side of the body for locating the terminal in the passageway and, at a portion of reducing width adjacent the tab-receiving portion, shoulders 89 which abut complementary shoulders formed in the passageway to drive the male and female terminals into engagement.

The tab-receiving portion is of reduced width and has opposite edges bent up on the one side to define a channel-section from the walls of which extend two spring arms 91 adapted to receive between them and grip a tab contact. Latching detents 90 extend from the other ends of the walls of the channels.

The wire-connecting portion includes a generally planar tab 92 extending from the web away from the tab-receiving portion and having a wire-locating mouth 94 at its forward, free end from which mouth a wire-receiving groove 95 extends rearwardly and centrally of the tab along the other side.

The female terminal is stamped and formed from sheet metal stock and comprises a wire-connecting portion including a central web 97 from opposite marginal edges of which extend spring arms rolled 98 over so that their free ends are adjacent one side of the web. It should be noted that the root ends of the arms extend initially out of the plane of the web on the other side. A wire locating mouth is formed centrally of the free end of the web. The web is of reducing width towards a terminal support portion 99 and opposite marginal edges are bent up to define shoulders similar in function to the shoulders 89. The terminal support portion is of reduced width having opposite marginal edges bent up from the web to form a channel-section stand. A latching detent 103 may be provided in base of the section.

The passageways of the housing 83 are of enlarged size towards a forward, mating end which enlargement is defined by a lateral extension 111 of one wall. The opposite side is formed with a series of wire-receiving slots 121. Shoulders and ledges 65, 66, 67 engage the shoulders 89, feet 88 and detents 90 when the terminal is in the housing. Housings 83 and 84 have complementary ribs and channels 78 and 79, respectively. The housing 84 has a lateral extension 122 along one wall at a rearward end which is adapted to engage a leading end of the extension 111 on mating the connector parts. The opposite wall is of reduced height and leading or forward edges of both walls are formed with aligned wire locating slots.

In operation, the wires are aligned with or inserted in respective slots 121 and the housings moved together guided by engagement of ribs 78 in channels 79 to drive the tab into the socket. This causes the end of the wire to be stripped of insulating, which is retained in a cavity 125 defined by the extensions 111 and 122, and the core to be squeezed or crimped longitudinally between the groove 95 and the web 97 of the terminals 85, 86.

The assemblies can then be mounted in a panel using a suitable mounting bracket.

Means may be provided to latch housings together to face either in the same or opposite directions and individual housings can be linked by integral flexible webs permitting different connector configurations.

In modified terminals (FIG. 4), the tabs 129 have slots 130 with mouths of restricted size formed by insulation severing lips 131. The female terminal 132 has a web 134 raised towards the spring arms and a leading edge 133 protruding away from the web. These modifications aid insulation stripping.

The connector is particularly suitable for use with harness making apparatus described in our Patent Application No. 709,981, filed on July 30, 1976.

What is claimed is:

1. An electrical connector assembly comprising:

a. a first housing of insulating material having a plurality of side walls forming at least one passageway opening into a forward mating end, said mating end having at least one inwardly, projecting elongated rib on one interior side wall surface, and at least one wire-receiving slot in a side wall in general alignment with the passageway;

b. at least one conductive male terminal positioned in the passageway in the first housing, said terminal having a body section with a wire-connecting portion at one end extending into the forward mating end of the housing, said wire-connecting portion comprising a generally planar tab having a wire-receiving groove extending from its free end rearwardly toward the body section;

c. a second housing of insulating material having one end adapted to be telescopingly received into the forward mating end of the first housing, said one end having on the exterior surface of one wall at least one channel positioned to slidingly receive the elongated rib positioned in the forward mating end so as to guide the housings together, further, said second housing having at least one passageway therethrough, said passageway in said second housing being in alignment with the passageway in the first housing; and d. at least one conductive female terminal positioned in the passageway of the second housing, said female terminal having on one end a wire-connecting portion comprising a web with arms extending laterally along either side to provide a tab receiving cavity, so that as the first and second housing are mated together, the wire-connecting portion on the male terminal is telescopingly received in the wire-connecting portion on the female terminal and a wire which may be inserted into the wire-connecting slot in the first housing in front of the male terminal is bent by the tab and web and crimped longitudinally in between the groove and the web.

2. The electrical connector assembly of claim 1 wherein said male and female terminals include a wire-locating mouth at the free end of the planar tab and web respectively.

3. The electrical connector assembly of claim 2 wherein said wire-locating mouths include insulating severing edges.

4. The electrical connector assembly of claim 3 in which said housings provide in cooperation at least one cavity adapted to receive insulation which may be stripped from the wire as the wire is bent by the interaction of said tab and web.

* * * * *